United States Patent [19]

Hamilton

[11] Patent Number: 4,833,575

[45] Date of Patent: May 23, 1989

[54] BRIGHTNESS EQUALIZING LIGHT FILTER SYSTEM

[75] Inventor: James L. Hamilton, Cambridge, Mass.

[73] Assignee: Lam Lighting Systems, Wakefield, Mass.

[21] Appl. No.: 207,250

[22] Filed: Jun. 15, 1988

[51] Int. Cl.[4] ..... F21S 3/02; F21V 5/00

[52] U.S. Cl. ..... 362/223; 362/260; 362/307; 362/308; 362/327

[58] Field of Search ..... 362/222, 223, 260, 290, 362/307, 308, 327, 331, 354, 355, 360; 313/110, 113, 116

[56] References Cited

U.S. PATENT DOCUMENTS

| | | | |
|---|---|---|---|
| 3,230,360 | 1/1966 | Short | 362/222 |
| 3,231,663 | 1/1966 | Schwartz | 362/354 |
| 3,351,753 | 11/1967 | Beroer | 362/327 |
| 4,568,860 | 2/1986 | Feinberg et al. | 315/255 |

*Primary Examiner*—Ira S. Lazarus
*Assistant Examiner*—Richard R. Cole
*Attorney, Agent, or Firm*—Charles E. Pfund

[57] ABSTRACT

The present invention provides a brightness equalizing light filter system which can be utilized as the bottom panel or as one of a set of bottom panels in an indirect fluorescent light fixture to evenly illuminate the fixture to approximately the same degree of brightness as the surrounding area which it lights. The brightness equalizing light filter system comprises a translucent diffuser panel with an opaque, electrically-connected pattern of thin metal film deposited thereon, wherein the density of the opaque pattern for each point on the panel is proportional to (or the linear function of) the intensity of light impinging on that point from the light source. The metal film serves both as the required electrical ground to act as a starting aid for the lamps and as a reflecting surface to increase the photometric efficiency of the fixture.

9 Claims, 1 Drawing Sheet

BRIGHTNESS EQUALIZING LIGHT FILTER SYSTEM

BACKGROUND OF THE INVENTION

This invention relates to a brightness equalizing light filter system used in conjunction with an indirect fluorescent light fixture.

A current problem with existing indirect, fluorescent light fixtures is that they appear dark as viewed against the relatively evenly illuminated ceiling which they light. This is a particular problem in an environment where people work at video display terminals, where the dark underbodies of such fixtures provide a distracting reflection on the CRT screen.

It would be desirable if the fixture itself could be illuminated to a brightness approximately that of the ceiling. One method to accomplish this would be to make the bottom surface of the fixture translucent, allowing some light to "leak" from the fluorescent source through the bottom of the fixture. However, due to the proximity of the light source to the translucent panel, a bright spot, or line, will appear near the center line of the panel with an apparent brightness much greater than that of the ceiling or the rest of the panel. This bright spot may be reduced by employing a second translucent panel and/or by integrating a pattern into the panel so as to block some of the light passing through.

One difficulty encountered in trying to design a light diffusing translucent bottom for the fixture is that the conventional types of fluorescent lamps, that is the rapid-start lamps, will not operate correctly unless a grounded metal plate or reflector is in close proximity to the lamps. This grounded metal plate serves as a "starting aid" and is necessary to quickly establish the required arc without undue flickering when the lamps are turned on.

SUMMARY OF THE INVENTION

The present invention provides a brightness equalizing light filter system which can be utilized as the bottom panel or as one of a set of bottom panels in an indirect fluorescent light fixture to evenly illuminate the fixture to approximately the same degree of brightness as the surface area which it lights. The brightness equalizing light filter system comprises a translucent diffuser panel with an opaque, electrically-connected pattern of thin metal film deposited thereon, wherein the density of the opaque pattern at each point on the panel is proportional to (or the linear function of) the intensity of light impinging on that point from the light source. The metal film serves both as the required electrical ground to act as a starting aid and as a reflecting surface to increase the photometric efficiency of the fixture.

DETAILED DESCRIPTION OF THE PREFERRED EMBODIMENT

The brightness equalizing light filter system of the present invention and its utilization in an indirect fluorescent light fixture may be more readily described with reference to the accompanying drawings.

Figure 1:
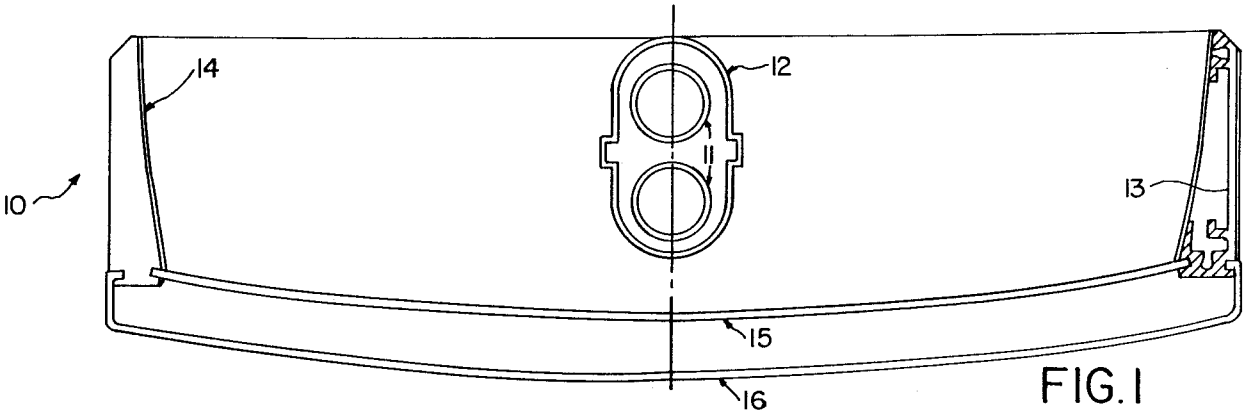
FIG. 1 is a cross-section of an indirect fluorescent light fixture of the present invention.

In FIG. 1 there is shown an indirect fluorescent light fixture 10 which is primarily adapted to reflect light upward so as to evenly illuminate the ceiling. This light fixture contains a pair of fluorescent lamps 11 centrally disposed along the longitudinal axis of the fixture and plugged into a lamp socket 12. Of course, the invention is applicable to fixtures with one tube or any plurality of tubes. The lamps are preferably located near the upper part of the fixture so that as much light as possible is directed toward the ceiling. The arrangement of the lamps as shown in FIG. 1, with one directly over the other, is especially preferred. A pair of reflectors 14 is disposed parallel to the lamps, preferably near the outer edge of the fixture and bent or curved slightly (i.e. concave to the lamps) so as to reflect light slightly upwardly toward the ceiling.

The overall design of the light fixture may be any of those conventionally employed or as desired for particular environments. In the embodiment shown, the fixture has vertical sidewalls 13 on each side, and at the front and back of the fixture, the sidewalls generally being fabricated of an aluminum alloy or sheet metal.

The fixture also has one or more translucent light diffusion panels located at the bottom of the fixture below the lamps, generally running the entire length and width of the fixture. It is preferred to utilize both an upper diffuser 15 and a lower diffuser 16 to achieve the most even illumination of the bottom surface of the fixture. In fact, the lower diffuser 16 is also preferably the bottom surface of the fixture.

The lower diffuser may be any conventional diffusion panel that is employed in the lighting industry. While the diffuser may comprise a conventional prismatic or louvered panel, it is preferred to utilize a conventional translucent diffuser panel, which may be glass or plastic.

The upper diffuser 15 is the key element of the present invention and provides the brightness equalizing effect desired. This upper diffuser comprises a translucent panel, generally made of glass or plastic, with an opaque pattern 17 of thin metal film deposited thereon. This opaque pattern is designed such that the density of the pattern of metal film applied to any point is proportional to the intensity of light impinging upon that point.

Figure 2:
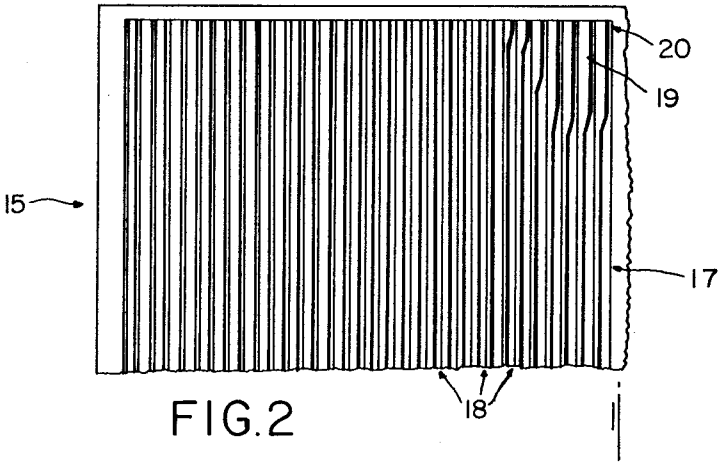
FIG. 2 is a partial plan view of the opaque metal pattern deposited on the diffuser panel utilized as the brightness equalizing light filter system for the light fixture of FIG. 1.

One type of opaque pattern that may be employed is depicted in FIG. 2, which illustrates a partial plan view of the left hand portion of the upper diffuser 15. In this figure, the opaque pattern is not drawn to scale, but is merely a rough illustration of the proposed concept. As can be seen, the opaque pattern comprises a series of opaque metal stripes 18 deposited on a translucent panel. The stripes are arranged parallel to the longitudinal axis of the fixture and are wider (i.e. the pattern is more dense) near the center of the fixture where the light intensity is greatest and gradually become narrower (i.e. the pattern is less dense) as they approach the outer edge of the diffuser panel. Thus, the stripes are designed to block more light at the center of the fixture, where the ratio of opaque area to translucent area is greatest, and to transmit more light near the edge of the fixture, where the ratio of opaque area to translucent area is lowest, giving an even illumination over the entire surface of the panel. As can also be seen in the pattern illustrated, a narrowing of the stripes in the region 19 is required since this region corresponds to the area under the socket 12, where the impinging light is less intense. Thus, the width of the stripes, and consequently the density of the pattern, varies both laterally and longitudinally as a function of the impinging light intensity. A cross connector 20 provides an electrical connection of all the stripes in the pattern so that the entire pattern may be grounded and serve as a starting aid for the lamps.

The exact point to point density of the opaque pattern may be arrived at mathematically. It is, however, more expedient and, thus, more preferred to produce the pattern using a direct method as follows. This method involves photographing the lighted fixture directly with a large graphic arts camera utilizing a high contrast film and a linear pattern half-tone screen. By diffraction effects created by the light passing through the screen a pattern will appear on the film with a density (i.e. ratio of opaque to clear) that is a function of the intensity of light incident on the film at each point. Thus, the exact pattern required is created on the film. From this film a photo silk screen can be made and utilized to produce the desired pattern on the diffusion panel.

The one method, the opaque pattern of metal film may be created by first depositing a thin layer of metal, such as aluminum, evenly over the entire top surface of the diffusion panel. This can be done by evaporation deposition or other known techniques. The desired pattern is then applied to the metal film by applying a lacquer or other protective material to the film through the silk screen previously described. After drying, the panel may be bathed in a solution, such as a caustic solution where aluminum is the metal used, to strip the unprotected metal from the panel, leaving only the metal film in the desired pattern.

Obviously, other techniques known to those skilled in the art for applying a metal film in a desired pattern to a substrate may be employed with eqaul advantage and the invention is not to be limited to the technique described above. For example, it may be possible to use photoresists or similar materials to create the desired pattern on the substrate, and plating techniques to deposit the metal film. It should also be apparent that the stripes which make up the opaque pattern may be disposed perpendicular to the longitudinal axis of the fixture, or even at other angles. In addition, the stripes need not be straight, but may also be wavy or have some other configuration. The only critical requirement is that the density of the opaque pattern vary in proportion to the intensity of the impinging light, irrespective of the particular pattern utilized. Of course, another significant requirement is that the pattern be such that the opaque portions are electrically connected so that the pattern can also function as the starting aid.

Thus, while the invention has been described with respect to its preferred embodiment, it should be understood to include those modifications and equivalents which will be readily apparent to those skilled in the art and within the spirit and scope of the appended claims.

What is claimed is:

1. A brightness equalizing light filter system for an indirect fluorescent light fixture comprising a translucent diffuser panel with an electrically-connected opaque pattern of metal film deposited thereon, wherein the density of the opaque pattern for any point on the panel is proportional to the intensity of light impinging on that point.

2. The light filter system of claim 1 wherein the opaque pattern comprises a series of opaque metal stripes of varying width such that said metal stripes are wider, making the opaque pattern more dense, on that portion of the panel where the impinging light is more intense, and narrower, making the opaque pattern less dense, on that portion of the panel where the impinging light is less intense.

3. The light filter system of claim 2 wherein the metal stripes are disposed parallel to the longitudinal axis of the panel.

4. The light filter system of claim 3 wherein the panel is adapted to be interposed between a light source within the light fixture and an exterior surface of the light fixture so as to evenly illuminate the exterior surface.

5. An indirect fluorescent light fixture with an evenly illuminated surface comprising a housing, a fluorescent light source mounted within the housing, the housing having an open or transparent upper end to allow light from the light source to illuminate a surface facing the upper end, and a bottom end which is evenly illuminated by the light source to approximately the same apparent brightness as the surface facing the upper end, and wherein interposed between the light source and the bottom end is a brightness equalizing light filter system comprising a translucent diffuser panel with an electrically-grounded opaque pattern of metal film deposited thereon, wherein the density of the opaque pattern for any point on the panel is proportional to the intensity of light impinging on that point.

6. The light fixture of claim 5 wherein the opaque pattern comprises a series of opaque metal stripes of varying width such that said metal stripes are wider, making the opaque pattern more dense, on that portion of the panel where the impinging light is more intense, and narrower, making the opaque pattern less dense, on that portion of the panel where the impinging light is less intense.

7. The light fixture of claim 6 wherein the metal stripes are disposed parallel to the longitudinal axis of the fixture.

8. The light fixture of claim 7 wherein the bottom end is a translucent plastic diffuser panel.

9. The light fixture of claim 8 wherein the opaque pattern functions as a starting aid for the fluorescent light source.

* * * * *